US007384612B2

(12) United States Patent
Ajisaka et al.

(10) Patent No.: US 7,384,612 B2
(45) Date of Patent: Jun. 10, 2008

(54) DIESEL EXHAUST GAS PURIFYING FILTER

(75) Inventors: Yasuo Ajisaka, 301, 108-1, Nuname 1-chome, Isehara-shi, Kanagawa (JP); Shigeru Kumai, Kawaguchi (JP); Yoshitaka Kumai, Kawaguchi (JP)

(73) Assignees: Kabushiki Kaisha Chemical Auto, Kawaguchi-shi, Saitama (JP); Yasuo Ajisaka (JP)

( * ) Notice: Subject to any disclaimer, the term of this patent is extended or adjusted under 35 U.S.C. 154(b) by 602 days.

(21) Appl. No.: 10/504,433

(22) PCT Filed: Feb. 17, 2003

(86) PCT No.: PCT/JP03/01660

§ 371 (c)(1),
(2), (4) Date: Aug. 13, 2004

(87) PCT Pub. No.: WO03/071106

PCT Pub. Date: Aug. 28, 2003

(65) Prior Publication Data

US 2005/0147541 A1 Jul. 7, 2005

(30) Foreign Application Priority Data

Feb. 19, 2002 (JP) ..... 2002-041485

(51) Int. Cl.
*B01D 53/34* (2006.01)
*B01D 45/00* (2006.01)
*B01J 23/00* (2006.01)

(52) U.S. Cl. ..... 422/177; 422/178; 502/302; 502/304; 423/213.5; 423/215.5

(58) Field of Classification Search ..... 422/177; 502/302–304; 423/213.5, 215.5
See application file for complete search history.

(56) References Cited

U.S. PATENT DOCUMENTS 4,167,852 A * 9/1979 Ludecke ..... 60/296
5,000,929 A * 3/1991 Horiuchi et al. ..... 423/213.5

(Continued)

FOREIGN PATENT DOCUMENTS

EP 0 884 457 A2 12/1998

(Continued)

OTHER PUBLICATIONS

"A summary of Japanese Utility Model Publication No. 1992-42212" pp. 1-2, (1992).

*Primary Examiner*—Walter D. Griffin
*Assistant Examiner*—Lessanework T Seifu
(74) *Attorney, Agent, or Firm*—The Nath Law Group; Jerald L. Meyer; Stanley N. Protigal

(57) ABSTRACT

An exhaust cleanup filter which, even if the exhaust temperature is low as during vehicular driving under low load, can trap PM efficiently to prevent clogging by PM buildup and which also is effective in purifying the exhaust from a diesel engine that does not use any burner or heater to remove PM. The cleanup filter is for purifying the exhaust from diesel engines and comprises particulate ceramic porous bodies that have a three-dimensional network structure, as well as artificial pores and communication channels in the interior, with some of the pores being partially exposed on the surfaces of the porous bodies.

14 Claims, 9 Drawing Sheets

U.S. PATENT DOCUMENTS 5,290,530 A * 3/1994 Muramatsu et al. ..... 423/239.1
5,322,821 A * 6/1994 Brezny ..... 501/80
5,384,290 A 1/1995 Brezny
5,399,535 A * 3/1995 Whitman ..... 501/80

FOREIGN PATENT DOCUMENTS

JP 2002-047916 2/2002

* cited by examiner

DIESEL EXHAUST GAS PURIFYING FILTER

TECHNICAL FIELD

This invention relates to a diesel exhaust cleanup filter for purifying and reducing the amounts of solid components such as particulate matter (PM) and harmful gaseous components in the exhaust gas from diesel engines on buses, trucks, ships, power generators, etc. More particularly, the invention relates to cleanup filters comprising particulate ceramic porous bodies having a three-dimensional network structure.

BACKGROUND ART

Exhaust from diesel engines on buses, trucks, etc. contain particulate matter, NOx (nitrogen oxides), etc. The particulate matter in turn contains insoluble organic fractions such as soot (carbon or C) and sulfates that are generated as the result of oxidation of sulfur in gas oil, as well as soluble organic fractions (SOF) such as HC either unburned or contained in lubricants. If released into atmospheric air, these fractions cause air pollution or adversely affect the human body, which are by no means desirable. To deal with this problem, a need has recently come to be realized to require by laws and regulations that diesel-powered vehicles such as buses and trucks should be equipped with devices that can control or eliminate PM and other harmful materials in diesel emissions.

In order to trap diesel particulate matter (hereunder sometimes abbreviated as PM) within the exhaust system, honeycomb filters shaped from ceramic materials were developed and have been known as diesel particulate filters (DPF). These honeycomb filters are available in two types, the straight flow type and the whirl flow type. In the former type, a large number of cells are formed within a matrix as partitioned by thin porous walls, with a catalyst being carried on the wall surfaces such that PM, CO, HC, etc. in the exhaust stream passing through the cells are reduced in concentration or rejected as they come into contact with the wall surfaces (prior art technology 1).

In the latter, whirl flow type, the matrix itself is a large number of cells that are made of a porous material and which are closed at their inlet and outlet alternately so that the exhaust stream entering one cell at the inlet passes through the thin porous partition to come into another cell from which it emerges through the outlet.

The soot component of PM is trapped by the partition on its surface or within pores in it. Honeycomb filters of the whirl flow type are classified in two sub-types, one having the catalyst carried both on the surfaces of cell partitions and within pores in the partitions and the other having no catalyst supported (prior art technology 2). In the former case, PM trapped on the surfaces of cell partitions and in their interior are catalytically removed by oxidation and in the latter case, the trapped PM is removed by combustion with a burner or a heater.

Also known is an exhaust cleanup apparatus using two types of honeycomb filter in combination, one being of the straight flow type and the other being of the whirl flow type, that are arranged in the same direction as the emission flow (Japanese Patent No. 3012249). The straight flow type honeycomb filter which is loaded with a regenerating oxidation catalyst system is provided in the upstream area of the tailpipe on a diesel engine and the whirl flow type honeycomb filter which is adapted to trap PM is provided in the downstream area. The regenerating oxidation catalyst system in the straight flow type honeycomb filter oxidizes NO (nitrogen monoxide) in the exhaust to generate more oxidative $NO_2$ (nitrogen dioxide) whereas the downstream, whirl flow type honeycomb filter oxidizes the trapped PM with $NO_2$ to generate $CO_2$, thereby reducing the level of PM.

According to this technique, the concentration of PM on the filters is continuously reduced, thereby ensuring that PM will not be so much deposited on the filters as to make further trapping of PM impossible. This offers the advantage of allowing for continuous regeneration of the filters (prior art technology 3).

However, the prior art technologies described above have their own problems. In prior art technology 1, the soot (carbon or C) in PM is not oxidized but simply released into the atmosphere. Further, if the exhaust temperature is low as on engine start-up, PM is directly deposited at the inlets of cells or the inner surfaces of their walls to plug the cell pores, thereby increasing the pressure loss.

In prior art technology 2, if no catalyst is supported on the surfaces of cell partitions or in their interior, PM deposited on the surfaces of cell partitions is removed by combustion with a burner or a heater. This presents various problems including the need to provide a heating and combustion means such as a burner or a heater, overall complexity of the apparatus, high failure rate and high cost. In addition, the use of a heater can cause abnormal combustion of PM deposited on the filter, often leading to fusion and cracking of the filter matrix.

If a catalyst is supported on the cell partitions, PM deposited on the filter is removed by oxidation at comparatively low temperature, so there will be no fusion or cracking of the matrix. On the other hand, when the exhaust temperature is low as on engine start-up or while the vehicle is driving at low speed or under small load, PM is oxidized insufficiently and prone to be deposited on the surfaces of filter cell partitions or in the cell interior. The exhaust passing through the pores in the cell partitions can cause various other problems such as increased chance of clogging, higher exhaust temperature due to increased back pressure of the exhaust, abnormal combustion of the deposited PM and fusion of the filter.

In prior art technology 3, the exhaust passes through the cell partitions in the filters for such a very short time that the remainder of $NO_2$ that has been spent to oxidize PM is not reduced to NO but simply discharged to the outside. If the exhaust temperature is low, say at 250° C. or less, the filters allow for only insufficient PM oxidation with $NO_2$ and the PM is deposited on the surfaces of cell partitions in the filters to cause various problems such as clogging, greater burden on the engine due to increased back pressure of the exhaust, abnormal combustion of PM due to increased exhaust temperature, fusion of the filters and their failure.

The present invention has been accomplished under these circumstances and has as an object providing an exhaust cleanup filter which, even at low exhaust temperature as is encountered during vehicular driving in a city, can achieve efficient reduction in the concentration of PM in the exhaust from diesel engines without being plugged by PM deposits.

Another object of the invention is to provide a cleanup filter that can achieve efficient reduction of the concentration of PM in the exhaust from diesel engines without using any burners or heaters to remove PM.

A further object of the invention is to provide a cleanup filter that can achieve efficient reduction of the concentration of PM in the exhaust from diesel engines without suffering increased exhaust temperature due to clogging and in which abnormal combustion due to PM deposits and filter fusion are less likely to occur.

A still further object of the invention is to provide an exhaust cleanup filter which, even if the engine is running at high rpm (under high load) during high-speed vehicular driving, is less likely to experience a blow-off of the PM trapped in it but can be regenerated efficiently.

DISCLOSURE OF THE INVENTION

Those objects of the invention can be attained by the cleanup filter according to claim 1 which is one for purifying the exhaust from diesel engines and which comprises a filter case filled with particulate ceramic porous bodies having a three-dimensional network structure and said particulate ceramic porous bodies having large numbers of artificial pores and communication channels in the interior, with some of the pores being partially exposed on the surfaces of said porous bodies.

Since the filters according to claim 1 has a three-dimensional network structure with large numbers of artificial pores and communication channels in the interior, they have a lot of chances for contact with PM in the exhaust, thereby achieving efficient trapping and removal of PM.

In addition, the pores are partially exposed on the surfaces of the particulate ceramic porous bodies, so when the exhaust passes through the packing of the particulate ceramic porous bodies, it collides with the surfaces of said porous bodies as it flows between adjacent porous bodies and the resulting turbulence in the exhaust stream sufficiently increases the chance of contact between the exhaust and the surface of each porous body to promote further adsorption and trapping of PM.

Claim 3 is the same as claim 1, except that the particulate ceramic porous bodies have pore sizes of 100 μm to 1000 μm.

Since the particulate ceramic porous bodies have a large number of artificial 100-1000 μm pores in the interior, PM can easily flow into the pores, where it provides sites of combustion for catalytic reaction. In addition, heat of combustion builds up within the pores to promote further burning of PM by way of the communication channels.

Claim 4 is the same as any one of claim 1 or 3 except that the particulate ceramic porous bodies are produced by mixing a ceramic feed with spheres of a thermoplastic resin such that those spheres occupy pore making portions, thereby having a large number of pores formed artificially and the communication channels that communicate the adjacent pores each other.

Since a large number of pores having desired sizes can be artificially formed in any desired manner, a cleanup filter can be provided that is filled with particulate ceramic porous bodies having optimum pores for trapping and removing PM.

Claim 5 is the same as any one of claims 1, 3 and 4, except that the particulate ceramic porous bodies have an average particle size of 4.0 mm to 20 mm.

Since the particulate ceramic porous bodies packed in a filter case have an average particle size of from about 4.0 mm to about 20 mm, the exhaust from a diesel engine suffers a comparatively small pressure loss from channel resistance, with the added advantage of providing more chances of contact between the exhaust and each of the particulate ceramic porous bodies.

Claim 6 is the same as any one of claims 1, 3-5, except that the particulate ceramic porous bodies contain silica as a main ingredient.

The particulate ceramic porous bodies in claim 6 contain silica as a main ingredient, so they have high heat resistance and low thermal expansion coefficient; hence, there can be provided a durable cleanup filter that undergoes only limited thermal expansion and shrinkage with relatively small possibility of thermal breakdown. In addition, the use of silica assures satisfactory catalyst supporting capability.

Claim 7 is the same as any one of claims 1, 3-6, except that the particulate ceramic porous bodies carry a catalyst system containing at least a noble metal catalyst.

Since the particulate ceramic porous bodies have a noble metal catalyst supported on their surfaces, within pores and communication channels, the exhaust can be effectively purified even if its temperature is low, say, at about 250° C. as is encountered when the vehicle is driving in congested, stop-and-go traffic.

Claim 8 is the same as any one of claims 1, 3-6, except that the particulate ceramic porous bodies carry a catalyst system containing at least a noble metal catalyst and an oxide catalyst.

The use of a noble metal catalyst and an oxide catalyst helps not only prevent poisoning, or inactivation, of the catalytic component by the sulfur component of the fuel but also make the catalyst system more durable.

Claim 9 is the same as claim 7 or 8, except that the noble metal catalyst is at least one member of the group consisting of platinum (Pt), palladium (Pd), rhodium (Rd) and iridium (Ir).

Claim 10 is the same as claim 8, except that the oxide catalyst is at least one member of the group consisting of cerium oxide, praseodymium oxide and samarium oxide.

BEST MODE FOR CARRYING OUT THE INVENTION

The term "particulate ceramic porous bodies" as used herein means those particulate ceramic porous bodies which carry a catalyst and should be distinguished from particulate ceramic porous bodies carrying no catalyst.

The term "cleanup filter" as used herein means a filter case packed with the particulate ceramic porous bodies defined above. Specifically, the cleanup filter comprises a case or a container of the above-defined particulate ceramic porous bodies and the exhaust from a diesel engine passes through the gap spaces formed of the large number of particulate ceramic porous bodies so that the concentration of PM is reduced.

The term "particulate ceramic porous bodies" as used herein means not only a single particulate ceramic porous body but also a large number of particulate ceramic porous bodies.

Figure 1:
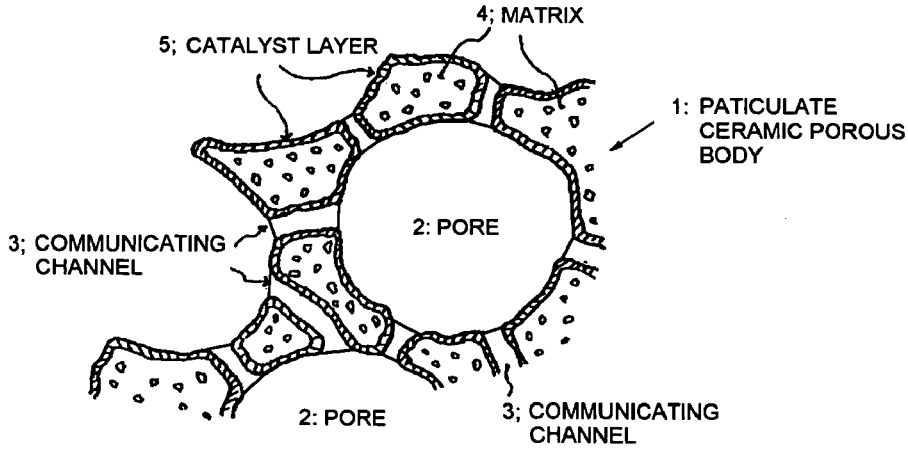
FIG. 1 is a schematic cross section which shows partially enlarged one of the particulate ceramic porous bodies which make up the diesel exhaust cleanup filter of the invention.
Figure 2:
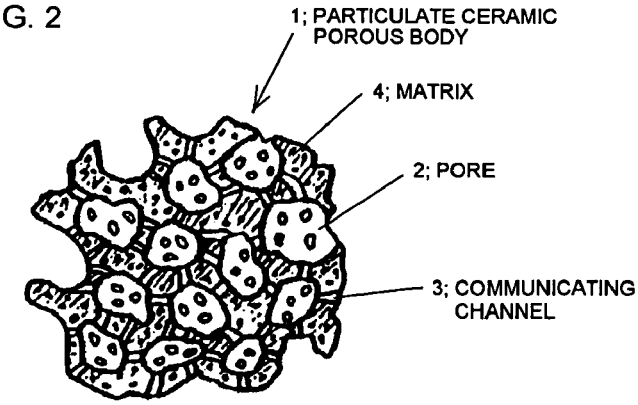
FIG. 2 is a schematic cross section which shows enlarged one such particulate ceramic porous body.

As shown in FIGS. 1 and 2, the particulate ceramic porous bodies of the invention have a three-dimensional network structure having communication channels in the interior.

With particular reference to FIGS. 1 and 2, the particulate ceramic porous body generally indicated by 1 has artificially formed pores 2 and communication channels 3 in the interior. Some of the pores 2 may be partially exposed on the surface of the porous body. The particulate ceramic porous body 1 is composed of a ceramic matrix 4 having a catalyst layer 5 formed on part or all of the surfaces of the pores 2 and the communication channels 3.

The particulate ceramic porous bodies of the invention may be produced by supporting a catalyst on the ceramic porous bodies described in Japanese Patent Laid-Open No. 141589/1996, which also describes the process for producing such ceramic porous bodies. Referring to that publication, a powder of ceramic feed is mixed with spheres of a thermoplastic resin and, after adding water and a binding agent (e.g. pulp waste liquor), the ingredients are mixed together with a blender to form a paste which is molded into a green shape in which the spheres of thermoplastic resin occupy the volume of pore forming portions; the green shape is then dried and fired to form the ceramic porous bodies. Drying of the green shape is preferably performed in two stages, the first at 80~240° C. and the second at 240~500° C. By drying of the first stage, the spheres of thermoplastic resin are fixed in the matrix of the green shape to form building blocks for pores.

Then, the green shape is subjected to drying of the second stage where it is heated to 240~500° C. At this stage, the spheres of thermoplastic resin melt and, as they are decomposed, flow between the particles of the ceramic feed to form communication channels. In this process, part of the ceramic feed containing the spheres of thermoplastic resin melts and, with air being supplied from those spheres, is sintered to form ceramic porous bodies having a three-dimensional network structure having pores and communication channels. Larger pores are formed from larger spheres of thermoplastic resin and vice versa. The size of pores can be controlled by modulating the size of the spheres of thermoplastic resin to be employed.

The ceramic feed is available from a variety of sources including: siliceous minerals such as siliceous stone, high-silica white clay and diatomaceous earth; aluminous minerals such as diaspore, bauxite and fused alumina; aluminosilicate minerals including clay minerals (e.g. kaolinic kibushi-clay and gairome-clay, and montmorillonitic bentonite), agalmatolite and sillimanite; magnesian minerals such as magnesite and dolomite; calcareous minerals such as limestone and wollastonite; chromium containing ores such as chromite and spinel; zirconian ores such as zircon and zirconia; and other minerals such as titanian minerals and carbonaceous minerals (e.g. graphite).

The spheres of a thermoplastic resin may be obtained from resins having melting points of 80~250° C. and fire points higher than 500° C. Examples are the spheres of acrylic resins, acrylonitrile resins, cellulosic resins, polyamide resins (nylon 6, nylon 6/6 and nylon 6/12), polyethylenes, ethylene copolymers, polypropylenes, polystyrenes, polybutadiene-styrene copolymers, polyurethane resins and vinyl resins.

The particulate ceramic porous bodies to be used in the cleanup filter of the invention are selected as appropriate from the above-listed ceramic feed materials as long as they are suitable for the purpose of producing a desired cleanup filter especially adapted to purify hot exhaust gas. Particularly preferred are those materials which contain silica as a main ingredient. Such materials have satisfactory catalyst supporting capability, high heat resistance and low thermal expansion coefficient; hence, using such materials, one can obtain a durable cleanup filter that undergoes only limited thermal expansion and shrinkage with relatively small possibility of thermal breakdown.

The particulate ceramic porous bodies of the invention may contain not only silica but also ceramics as main ingredients and exemplary ceramics include alumina, cordierite, titania, zirconia, silica-alumina, alumina-zirconia, alumina-titania, silica-titania, silica-zirconia, titania-zirconia and mullite. Using these materials, one can obtain a heat-resistant cleanup filter that can withstand hot exhaust gas from diesel engines.

The particulate ceramic porous bodies of the invention have a catalytic layer that carries a noble metal, an oxide or other catalysts. Commonly used catalytic noble metals may be employed as exemplified by platinum (Pt), palladium (Pd), rhodium (Rh) and iridium (Ir). Using these noble metals as catalyst, one can achieve effective cleanup of a cold (ca. 250° C.) exhaust which typically occurs during driving in heavy traffic. Oxides that can be used as catalyst include $CeO_2$, $FeO_2$, $Pr_2O_3$ and $Pr_6O_{11}$. By using a noble metal and an oxide in combination as catalysts on the catalytic layer, one can prevent the poisoning, or inactivation, of the catalyst components by the sulfur component of the fuel so as to render the catalyst system more durable. The catalysts can be supported by conventional techniques, for example, by impregnating the particulate ceramic porous bodies with a catalyst containing slurry, drying and firing them.

In order to ensure frequent contact with the exhaust gas, the particulate ceramic porous bodies of the invention have preferably an average particle size of from about 4.0 mm to about 20 mm.

The pores formed artificially within the particulate ceramic porous bodies of the invention have preferably pore sizes of from 100 μm to 1000 μm. The pores of this size are formed not only in the interior of each of the particulate ceramic porous bodies but also exposed on their surfaces. Those pores are formed of the basic building blocks that are made by fixing the aforementioned spheres of thermoplastic resin within the matrix of the green shape. The pores formed according to the invention should be distinguished from those which were initially present in the ceramic porous bodies. Containing a large number of pores having the size set forth above, the particulate ceramic porous bodies of the invention permit easy flow of PM into the pores, where the PM provides sites of combustion for catalytic reaction. In addition, heat of combustion builds up within the pores to promote further burning of PM by way of the communication channels.

The particulate ceramic porous bodies of the invention can be packed in one or more cleanup filters which are mounted in an exhaust purifier. If a plurality of cleanup filters are to be installed, they may be in series or in parallel to the exhaust stream.

The particulate ceramic porous bodies as placed in the filter case form a packing layer in which the surface of one porous body is in intimate contact with the surface of another, so they will neither move about nor come apart from vibrations, shakes, sudden stops, sudden starts and other vehicular motions. As a result, there is provided a durable filter that is free from the wear and damage of the porous bodies even if they are vibrated, shaken or otherwise moved abruptly during vehicular driving.

The particulate ceramic porous bodies have a large number of spaces of varying size formed between themselves, so a multiple of continuous channels are formed that extend from the inlet to the outlet of the filter case and through which the exhaust can pass. The exhaust gas supplied into those channels flows in serpentine paths and is directed toward their end as they make random collision with the particulate ceramic porous bodies. Thus, the exhaust gas contacts high proportions of the surfaces of the packed particulate ceramic porous bodies over a prolonged period to be capable of trapping the soot in PM with high enough efficiency. The spaces between the particulate ceramic porous bodies to be formed within the filter case are variable with the size, shape, packing density, etc. of the particulate ceramic porous bodies; preferably, gaps are formed that range generally from about 1 mm to 5 mm.

The filter case for packing the particulate ceramic porous bodies of the invention may be of any shapes including cylindrical, oval, flat and rectangular. A cylindrical filter case is generally preferred.

Figure 3:
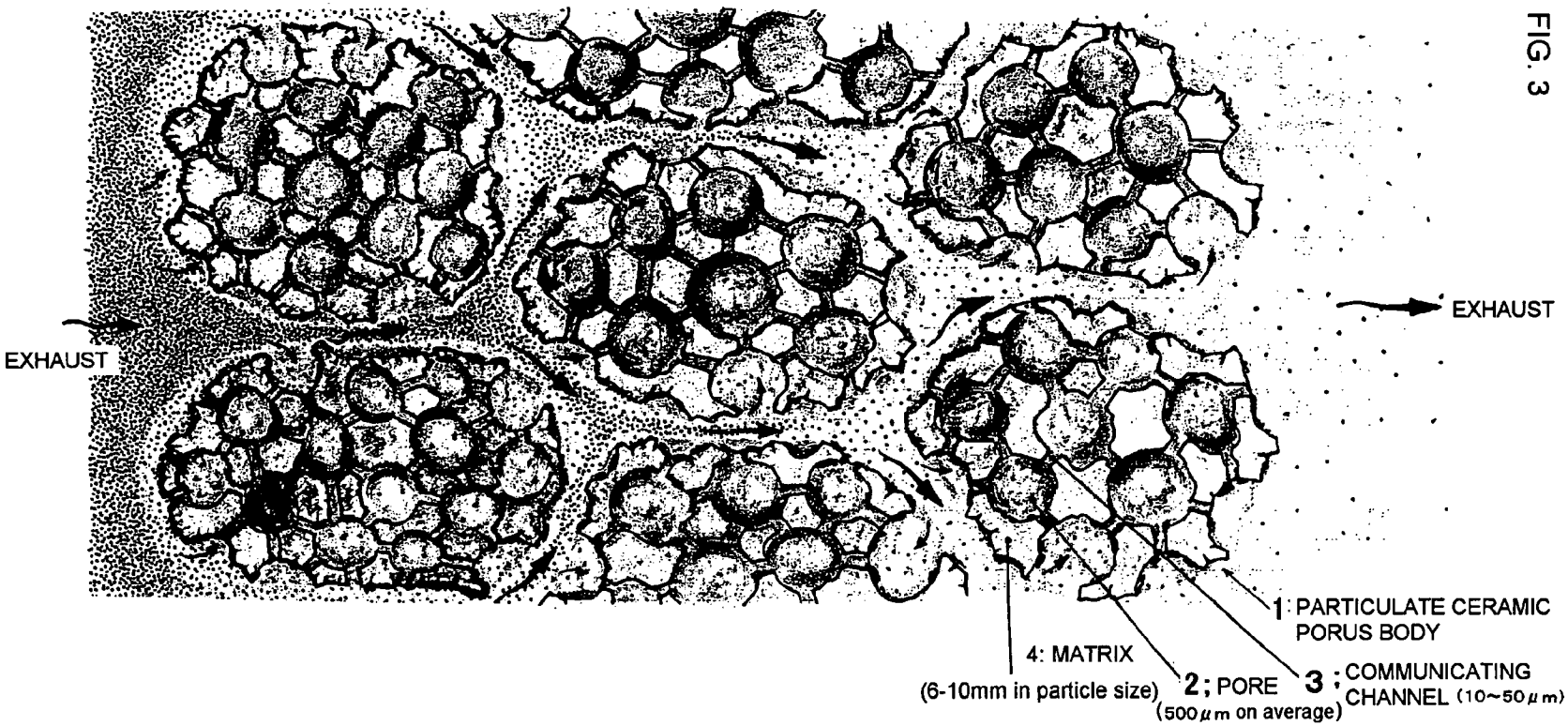
FIG. 3 is a schematic representation of the mechanism by which PM is trapped in the cleanup filter of the invention which comprises a filter case packed with the particulate ceramic porous bodies.

FIG. 3 is a schematic representation of the mechanism by which PM is trapped in the cleanup filter of the invention which comprises a filter case packed with the particulate ceramic porous bodies. Referring to FIG. 3, the soot in the exhaust flows between adjacent particulate ceramic porous bodies 1 as it collides with their surfaces and, in the meantime, the soot is adsorbed onto those surfaces and trapped by the artificial internal pores 2 and communication channels 3.

Each of the particulate ceramic porous bodies 1 of the invention has pores 2 partially exposed on the surface, so a large number of cavities are formed in it. As a result, forced turbulence is created in the stream of the exhaust as it passes through the filter and the frequency of its contact with the particulate ceramic porous bodies 1 is sufficiently increased to provide greater chance for trapping of PM.

Each of the particulate ceramic porous bodies 1 has a large number of pores 2 (with an average size of, say, about 500 μm) that are formed artificially in the interior of the ceramic matrix and connected by communication channels 3 which are also formed artificially within the matrix. Hence, the particulate ceramic porous bodies 1 have a large specific surface area (about 60 $m^2$ per liter of volume), as well as high gas permeability (equivalent to 70~80% porosity). As a result, the exhaust can get deep into the interior of the particulate ceramic porous bodies 1 and PM is not only adsorbed onto their surfaces but also trapped by the internal pores 2 and communication channels 3.

The particulate ceramic porous bodies preferably carry both an oxide (e.g. $CeO_2$) and a noble metal (e.g. Pt) as catalysts. In the presence of these catalysts, NO in the exhaust is oxidized to $NO_2$ which has strong enough oxidizing power to remove PM by subsequent oxidation.

In the cleanup filter packed with the particulate ceramic porous bodies of the invention within the filter case, the stated two reactions progress simultaneously to reduce the PM level. In the cleanup filter packed with the particulate ceramic porous bodies of the invention, the exhaust gas flows through the gaps (spaces) formed between adjacent particulate ceramic porous bodies, so even at low exhaust temperature that provides favorable conditions for PM buildup, the ability of the particulate ceramic porous bodies to trap PM is maintained at high enough level to ensure that there are always channels for the exhaust to pass through. As will be demonstrated in the Example to described later, when the present inventors performed an experiment on an in-use liner bus, the average temperature in the filter installed on the bus was maintained as low as about 230° C. while it was driving in a city at an average speed of 20 km/h. Even under such untoward conditions, there were transient exhaust temperature zones that exceeded 250° C. to permit effective filter regeneration.

The cleanup filter packed with the particulate ceramic porous bodies of the invention can reduce the levels of not only PM but also HC and CO. This is due to the oxidative reaction initiated by the catalyst component working as an oxidation catalyst. The efficiency with which the particulate ceramic porous bodies can trap the soot in PM depends on the amount of their loading. If the loading of the particulate ceramic porous bodies is decreased, their ability to trap the soot is lowered and so is the percent reduction of the PM level. Therefore, it is important to pack the filter with an appropriate amount of the particulate ceramic porous bodies.

The loading of the particulate ceramic porous bodies in the filter case is preferably so determined as to satisfy several requirements including the following: the reduction of the PM level should be at least 60%; the burden on the engine due to increasing back pressure of the exhaust should not be high enough to cause trouble during driving; fuel consumption should be held to no more than 5%. Specifically, the loading of the particulate ceramic porous bodies is preferably set at a suitable value that is determined from empirical values of the trap efficiency and the change in back pressure versus the amount of loading.

The particulate ceramic porous bodies in the filter case produce an initial value of back pressure at about 1.0~1.3 $kg/cm^2$ when the exhaust purifier is mounted on the engine. This is a value observed when the engine is operating at full load for the case where the second-stage cleanup filter in a two-stage filter unit in one exhaust purifier is filled with 6 liters of the particulate ceramic porous bodies. In the case of a diesel-powered vehicle which usually has to drive in congested traffic, PM constantly builds up on the surfaces and in the interior of the particulate ceramic porous bodies with the lapse of time, so their porosity decreases to increase the resistance of the exhaust, thus producing a higher back pressure during measurement. This is because given repeated processes of PM deposition and filter regeneration, if the exhaust temperature as an operating condition is generally low, PM deposition is a dominant case and the measured value of back pressure will change with the amount of PM buildup. In certain cases, the initial back pressure may be as high as 1.6 kg/cm$^2$ but this will not cause any big problem on the driving of the diesel-powered vehicle.

For packing the particulate ceramic porous bodies of the invention in the filter case, there is no limitation on their particle size. They may have substantially the same particle size throughout the filter case from the inlet to the outlet. Alternatively, large particles may be packed at the inlet and nearby areas, medium-sized particles in the intermediate zone, and smaller ones at the outlet and nearby areas. On account of the ingress of the exhaust into the filter case, more of the PM is trapped at the inlet and nearby areas, often causing the exhaust channels to be clogged by PM deposits.

This is not the case of the cleanup filter packed with the particulate ceramic porous bodies of the invention. Even if the inlet and nearby areas are clogged by PM, there are gap volumes in the exhaust channels at the outlet and in the nearby areas, so the PM trapped at the inlet is dislodged by high-speed exhaust streams and forced toward the outlet. This is a kind of "blow-off" which helps control the plugging by PM to a comparatively low level. This advantage is prone to occur when the particulate ceramic porous bodies are packed in the filter in three varying sizes at the inlet, in the intermediate zone and at the outlet. Therefore, the particulate ceramic porous bodies are preferably packed in the filter in a plurality of sizes corresponding to the areas where they are packed. Take, for example, two particle sizes, one about 10 mm and the other about 5 mm. Given the same volume, particles of about 5 mm occupy a surface area which is nearly twice the area occupied by particles of about 10 mm; therefore, the smaller the size of the particulate ceramic porous bodies in a packing layer, the larger the area of PM adsorption and the greater the ease of PM trapping. With the smaller particles, the total gap volume to be formed is invariable but more gaps are formed from a stack of the particulate ceramic porous bodies. In other words, exhaust channels which are large at the inlet become progressively smaller towards the outlet and increase in number. As a result, a balance is struck in the efficiency of PM trapping between the inlet and the outlet of the filter and the PM dislodged at the inlet or its nearby areas can be retrapped at the outlet or its nearby areas.

EXAMPLE

[Physical Properties of the Particulate Ceramic Porous Bodies of the Invention]

A cleanup filter having the particulate ceramic porous bodies packed in a filter case was subjected to tests to measure the PM level reduction in different temperature zones, as well as the changes in the exhaust temperature in the exhaust purifier and the back pressure that developed before and after vehicular driving.

The physical properties of the particulate ceramic porous bodies employed in the tests are set forth below.

| | | |
|---|---|---|
| (1) | Shape | Particles (formed by extrusion molding) |
| (2) | Bulk specific gravity (g/cm$^3$) | 0.06 |
| (3) | Particle size (mm) | 5~10 |

-continued

| | | |
|---|---|---|
| (4) | Pore size (μm) | 50~600 (median = 500 μm) |
| (5) | Porosity (%) | 80 |
| (6) | Specific surface area (m$^2$/g) | 2.4 |
| (7) | Crushing strength (kg/cm$^2$) | 5~10 |
| (8) | Percent wear (wt %) | 0.25 |
| (9) | Carriers | $SiO_2$ and $Al_2O_3$ |

[Composition of Particulate Ceramic Porous Bodies]

TABLE 1

| Composition | |
|---|---|
| $SiO_2$ | 88.9% |
| $Al_2O_3$ | 7.6% |
| $Fe_2O_3$ | 0.3% |
| $K_2O$ | 2.0% |
| $Na_2O_2$ | 0.8% |
| $TiO_2$ | 0.2% |
| CaO | 0.1% |
| MgO | 0.1% |

[Methods of Testing Physical Properties]

(1) Bulk specific gravity (g/cm$^3$) and porosity (%) were determined by the following formulas in accordance with JIS R2205-74.

Bulk Specific Gravity (g/cm$^3$):

Mass/outer volume*$^2$=dry weight/(water-inclusive weight−weight in water of water-inclusive sample)

Porosity (%):

Open pore volume*$^1$/outer volume*$^2$=water-inclusive weight−dry weight/(water-inclusive weight−weight in water of water-inclusive sample)

*$^1$: open pore=communicating channel

*$^2$: outer volume=aggregate+closed pores+communicating channels (2) Particle size (mm) was measured by the testing method in accordance with JIS Z8801. The method typically involves sieving with a Ro-Tap shaker. The Ro-Tap shaker has a stack of several screens that are shaken and the particles of a sample that are retained on the bottom-most screen are subjected to size measurement.

(3) Pore size (μm) was determined by mercury porosimetry and water displacement for small pores and by size measurement under electron microscope for large pores.

(4) Specific surface area (m$^2$/g) was determined by the BET single-point method from isotherm adsorption lines of gases such as nitrogen.

(5) Crushing strength (kg/cm$^2$) was determined in accordance with JIS R2615-85 by applying compressive weight to a sample of 1×1×1 cm in size until it breaks and then dividing the yield point of the sample by its cross-sectional area.

[Exhaust Purifier Used in Measurement]

Figure 4:
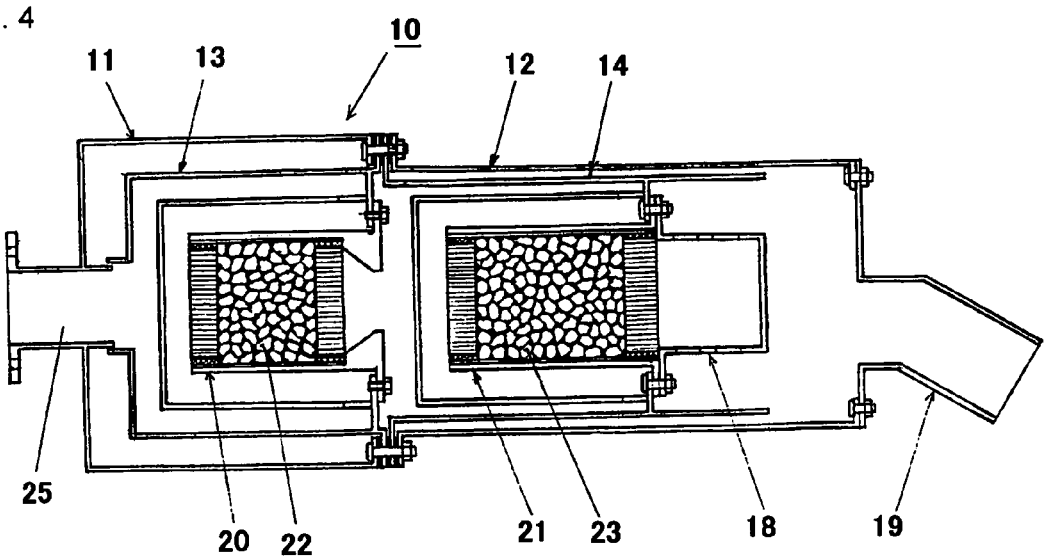
FIG. 4 is a schematic cross section of a purifier fitted with two cleanup filters of the invention.

FIG. 4 is a schematic cross section of an exhaust purifier fitted with the cleanup filter of the invention. In the experiment, the exhaust cleanup filter comprising the particulate ceramic porous bodies of the invention was installed in two locations along the exhaust stream. The exhaust purifier generally indicated by 10 in FIG. 4 consists basically of two main casings 11 and 12, inner casings 13 and 14 fitted detachably within the main casings 11 and 12, respectively, and filter cases 20 and 21 also fitted detachably within the main casings 11 and 12, respectively. Fitted within the filter cases 20 and 21 are cleanup filters 22 and 23 that are packed with the particulate ceramic porous bodies of the invention. Indicated by 18 is an exhaust nozzle, 19 is an exhaust outlet, and 25 is an exhaust inlet.

The various parts of the diesel exhaust purifier 10 had the following dimensions: outside diameter of main casing 11, ca. 300 mm; outside diameter of main casing 12, ca. 240 mm; length of main casing 11, ca. 300 mm; length of main casing 12, ca. 470 mm; outside diameter of inner casing 13, ca. 220 mm; outside diameter of inner casing 14, ca. 220 mm; length of inner casing 13, ca. 265 mm; length of inner casing 14, ca. 465 mm; outside diameter of filter case 20, ca. 160 mm; outside diameter of filter case 21, ca. 160 mm; length of filter case 20, ca. 210 mm; length of filter case 21, ca. 390 mm; diameter of exhaust nozzle 18, ca. 100 mm; diameter of exhaust outlet 19 and exhaust inlet 25, ca. 100 mm. "NAGAO POCEL SG1" (product name of NAGAO) having the physical properties set forth above was used as a mass of the particulate ceramic porous bodies and conditioned to carry 15 g of $CeO_2$ and 1 g of Pt as catalysts per liter (ca. 300 g). Such porous bodies were packed in about 2.5 L into the cleanup filter at the first stage of the purifier and in about 6 L into the second-stage filter.

The diesel exhaust purifier thus set up was installed on a liner bus and subjected to testing. Described below are the specifications of the liner bus under test, the items on test and the methods of measurement.

[Specifications of the Test Vehicle]

| | |
|---|---|
| Type | Liner bus |
| Model | Mitsubishi U-MP218K |
| Total displacement | 11,149 cc |

[Items on Test]

(a) The changes in the exhaust temperature within the purifier due to vehicular driving in a heavy traffic area were measured; also measured was the back pressure of the exhaust that developed before and after the driving.

(b) In order to measure the reduction of PM level in varying temperature zones, the liner bus was operated at constant speed and the resulting changes in the exhaust temperature within the purifier and in the back pressure were measured. In addition, the PM deposits at the outlet and inlet of the purifier were sampled for a specified period of time and their weight was measured.

Figure 5:
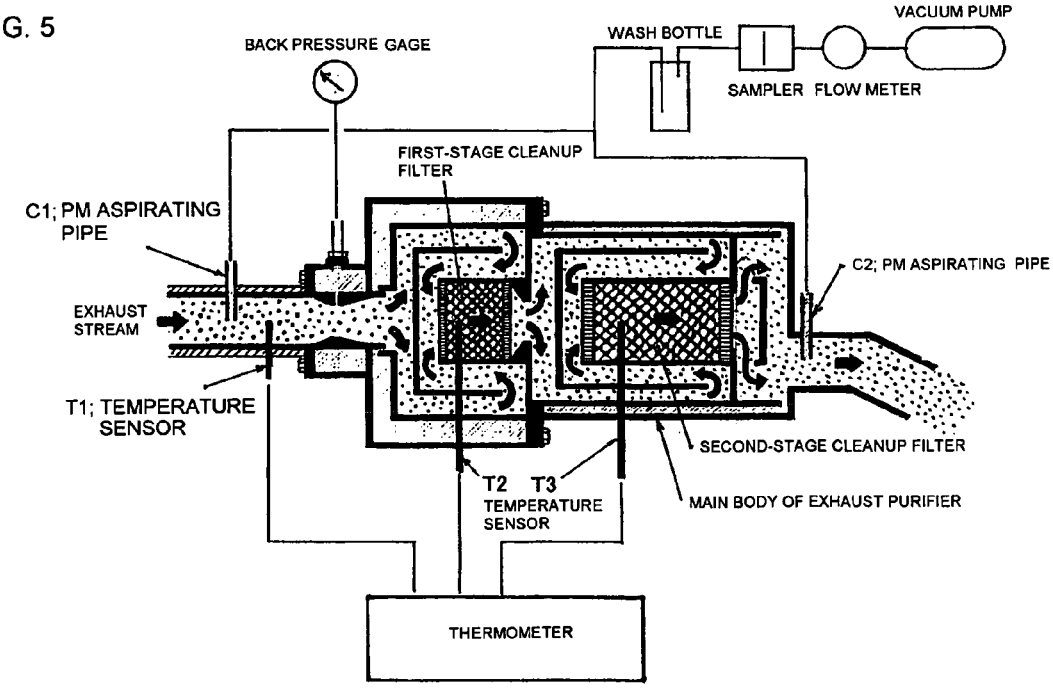
FIG. 5 is a schematic representation showing the sites of measurement with various instruments on the purifier fitted with two cleanup filters of the invention.

The instruments used in the measurements and the sites of measurement are depicted in FIG. 5.

[Methods of Measurement]

(1) Temperature Measurement

The exhaust temperature was measured in the following three locations:

(a) the center of the tailpipe at the inlet of the purifier (point $T_1$ in FIG. 5)

(b) the center of the first-stage filter (point $T_2$ in FIG. 5)

(c) the center of the second-stage filter (point $T_3$ in FIG. 5)

The two following two instruments were used to measure the exhaust temperature:

| | |
|---|---|
| (a) sensor | Thermocouple Yamari Thermic Type K JIS2 (D = 1.6 mm) 316L 200 |
| (b) recorder | Hybrid Recorder (dot marking type) of CHINO CORPORATION, AH 560-NNN with range No. 21 (0~1000° C.) |

(2) PM Measurement (a) A 6-mm copper pipe was installed both within the tailpipe at the inlet of the purifier and at the outlet (points $C_1$ and $C_2$ in FIG. 5) and the PM passing those positions was measured.

(b) The exhaust from the driving bus was sampled within a specified period of time by aspiration with a vacuum pump and the PM concentration in the exhaust was measured from the increase in the weight of the filter paper that retained the PM.

(3) Back Pressure Measurement

In order to measure the exhaust's resistance that would develop during vehicular driving, a pressure gage was installed at the inlet of the purifier and the back pressure of the exhaust was measured.

[Results of Measurements During Driving in a City]

(a) Reduction of PM Level

TABLE 2

| | Before installation | After installation |
|---|---|---|
| CO (g/km) | 2.99 | 0.44 |
| HC (g/km) | 1.66 | 0.12 |
| NO (g/km) | 8.22 | 8.63 |
| $CO_2$ (g/km) | 758 | 839 |
| Fuel consumption (km/L) | 3.39 | 3.10 |
| PM (g/km) | 1.06 | 0.21 |

Table 2 shows the result of an exhaust test conducted at the Tokyo Metropolitan Research Institute for Environmental Protection. The actual driving pattern providing a basis for the data in Table 2 simulated the mode of driving in the cener of Tokyo Metropolis at an average speed of 18 km/h. The test vehicle emitted 1.06 g of PM (particulate matter) per km. After the vehicle was equipped with the cleanup filters packed with the particulate ceramic porous bodies of the invention, the PM emission lowered to 0.21 g/km and the reduction was by 80.2%. From these results, it can be seen that even if the exhaust temperature is low due to driving through heavy traffic as in a city, the cleanup filter of the invention traps PM efficiently and permits driving without being clogged by PM buildup. The invention can also provide a cleanup filter for the exhaust from a diesel engine that does not have to use any burner or heater to remove PM.

Figure 6:
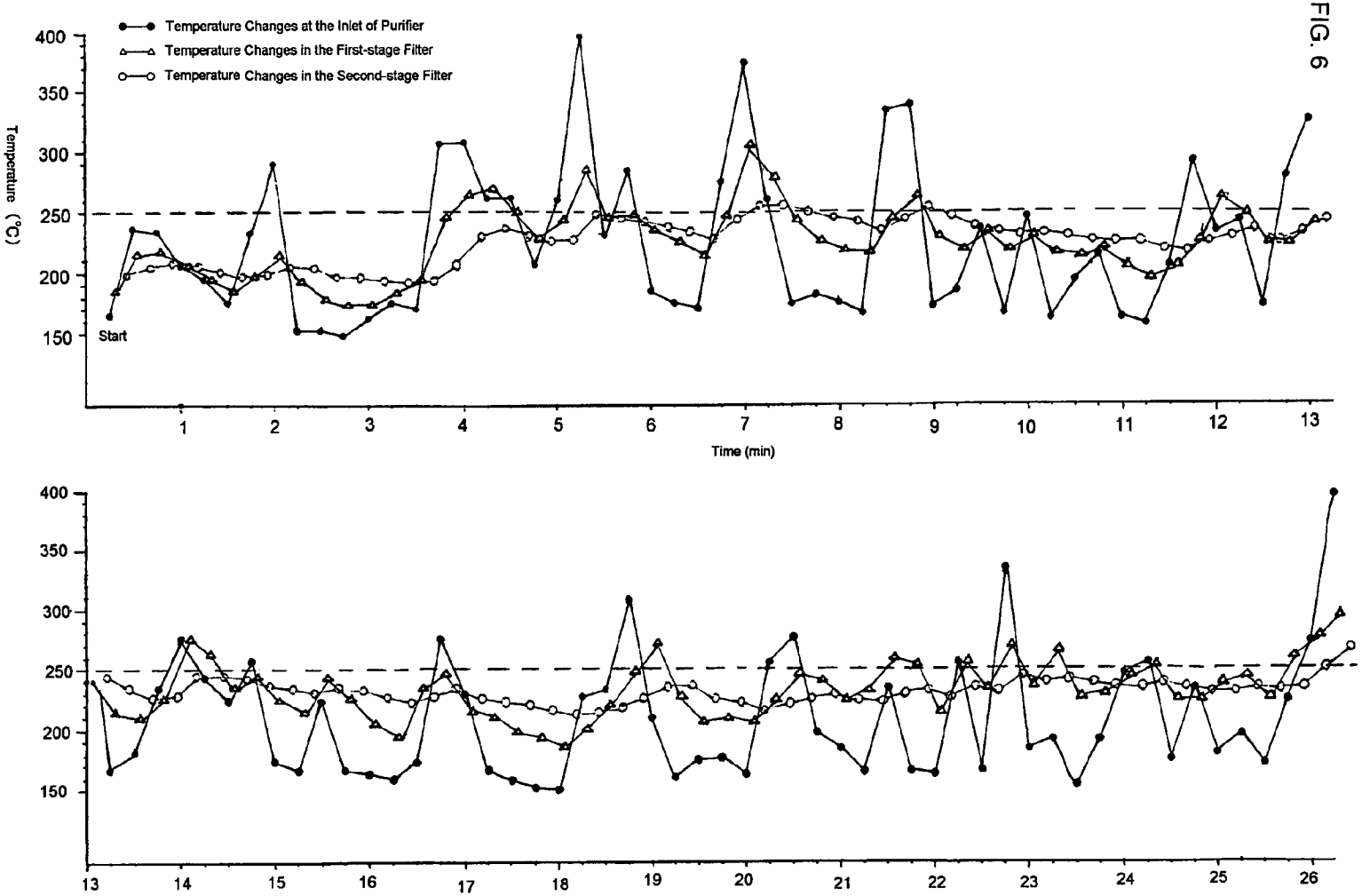
FIG. 6 is a graph showing temperature changes in the exhaust from a vehicle driving in a city.
Figure 7:
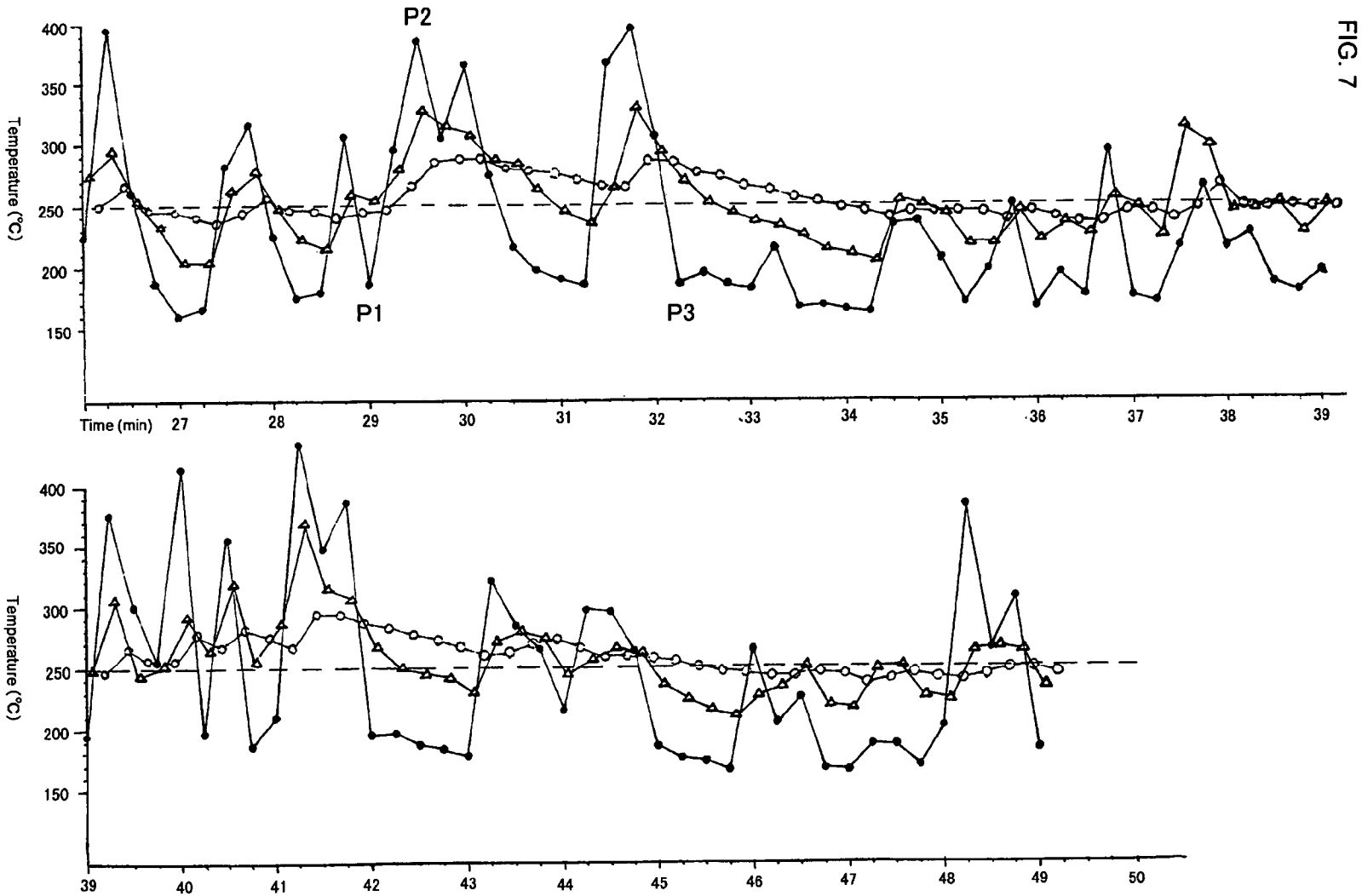
FIG. 7 is a graph which, being a sequel to FIG. 6, also shows temperature changes in the exhaust from a vehicle driving in a city.

(b) The changes in the exhaust temperature due to driving in a city are depicted in FIGS. 6 and 7. The driving was also in heavy traffic in order to comply with the velocity profile of the test according to the actual pattern of driving in the center of Tokyo Metropolis.

(c) Temperature profile during driving in a city

For about 30 minutes ($P_1$) of driving, the temperature in the filters changed between 200° C. and 250° C. for two major reasons; it was right after the start of driving and there were a lot of stops at traffic signals. Beyond 30 minutes, the vehicle speed made a transient increase at $P_2$ whereupon the temperature in the filters increased to 280° C.; thereafter, the vehicle got into congested traffic ($P_3$) and the temperature at the inlet of the purifier was frequently at about 170° C.; nevertheless, the temperature in the filters was held substantially constant at about 250° C. Thus, the filters could be regenerated by catalytic action even when the test vehicle was driving in heavy traffic areas of a city.

The average temperatures observed at the three points of measurement are indicated below.

(d) Average Temperatures

| | |
|---|---|
| At the inlet of the purifier | 220° C. |
| In the first-stage filter | 232° C. |
| In the second-stage filter | 230° C. |

During traffic congestion, the average temperatures in the cleanup filters of the invention were maintained higher than the average temperature at the inlet of the purifier and the buildup of PM deposits predominated; when the average temperatures in the filters temporarily exceeded 250° C., the PM deposits in the filters were burned away by catalytic action and the filters were effectively regenerated to prevent further PM buildup.

(e) Verifying Filter Regeneration

Figure 8:
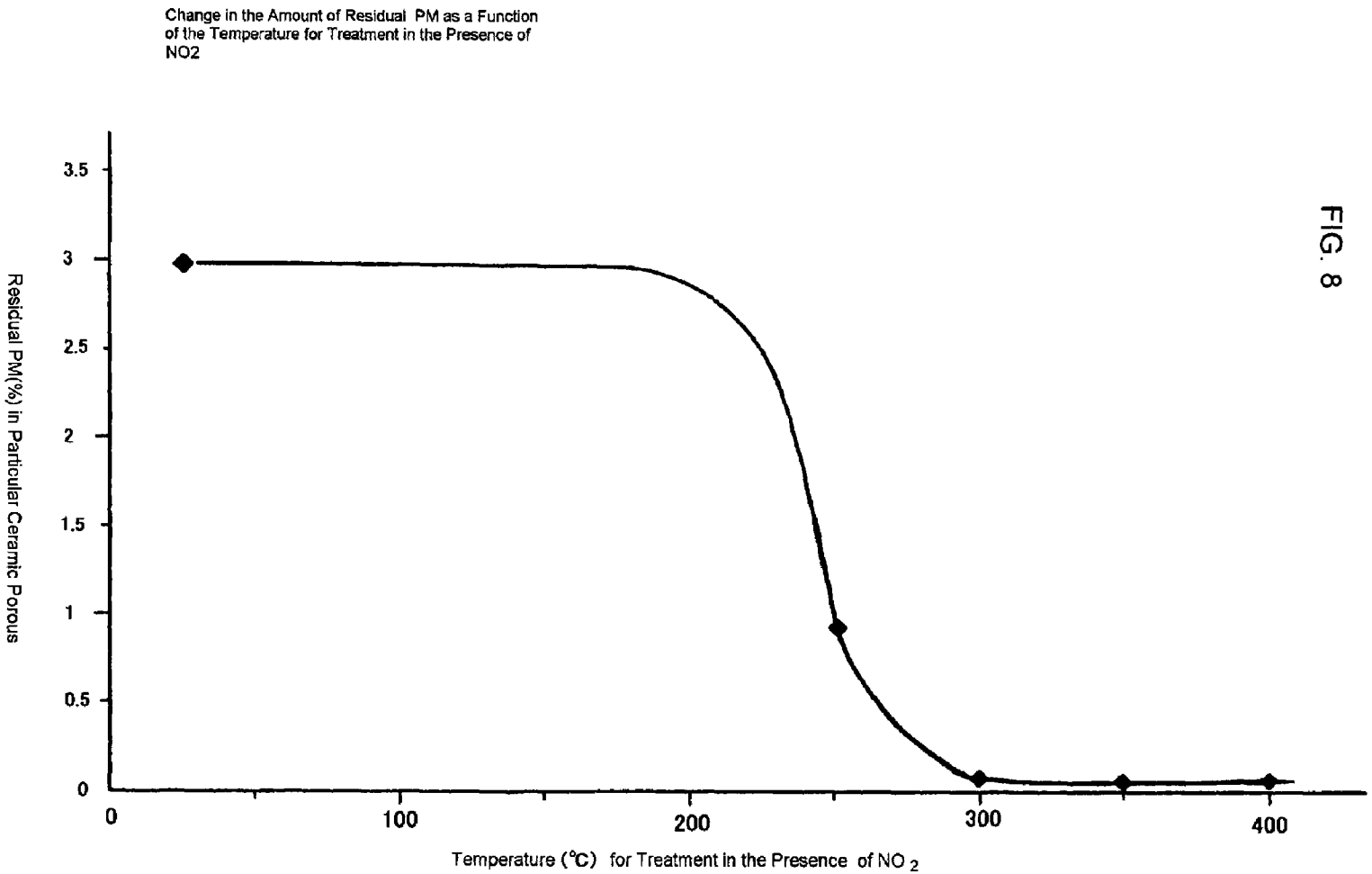
FIG. 8 is a graph showing the change in the amount of residual PM deposits on the particulate ceramic porous bodies of the invention that were partly taken out of the filter after vehicular driving for 4000 km and which were subsequently treated in the presence of $NO_2$ at different temperatures.

In order to verify the regeneration of the cleanup filters of the invention, the particulate ceramic porous bodies of the invention were partly taken out of the filters after driving 4000 km and the PM deposited on the porous bodies was subjected to a burning test in the presence of $NO_2$. The result is shown in FIG. 8, from which one can see that at 250° C. the PM deposition on the filters decreased to a third of the initial level, indicating the regeneration of the filters by burning off the PM. It can also be seen that beyond 300° C., there was hardly any deposition of PM on the particulate ceramic porous bodies of the invention, another evidence for positive regeneration of the particulate ceramic porous bodies of the invention.

[Results of Measurements During Driving at High Speed]

The test vehicle equipped with the purifier using the cleanup filters of the invention was operated at constant speeds of 60 km/h, 70 km/h and 80 km/h. The obtained data for the reduction of PM level are shown in Table 3.

km/h and 80 km/h, respectively. This data proves that the purifier equipped with the cleanup filters of the invention allowed for filter regeneration. It can also be seen from Table 3 that the purifier enabled consistent driving at each of the test speeds with little change being introduced into the back pressure of the exhaust.

Figure 9:
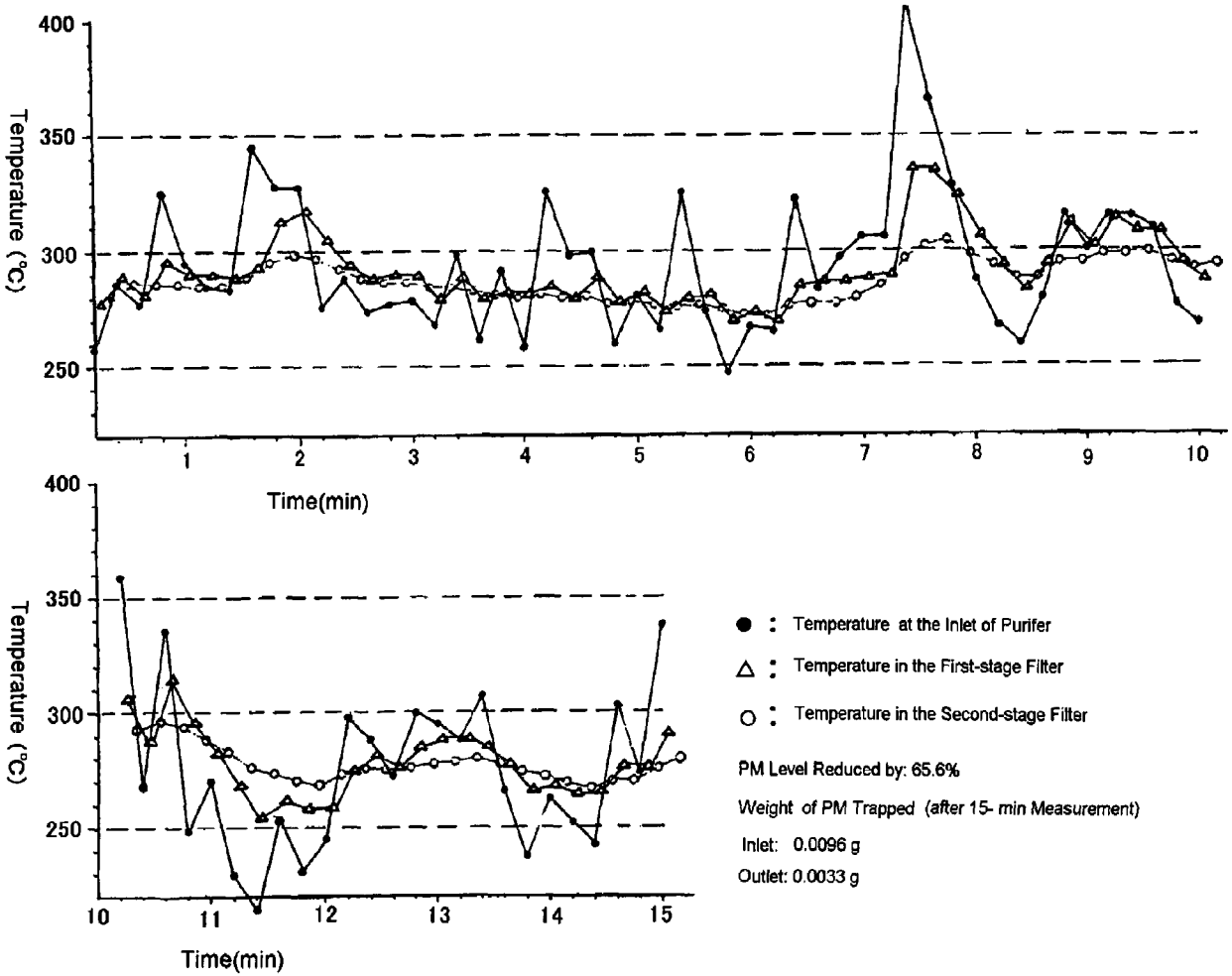
FIG. 9 is a graph showing the changes in the temperature of an exhaust from a diesel-powered vehicle that was driving at 60 km/h and which had the purifier fitted with two cleanup filters of the invention.
Figure 10:
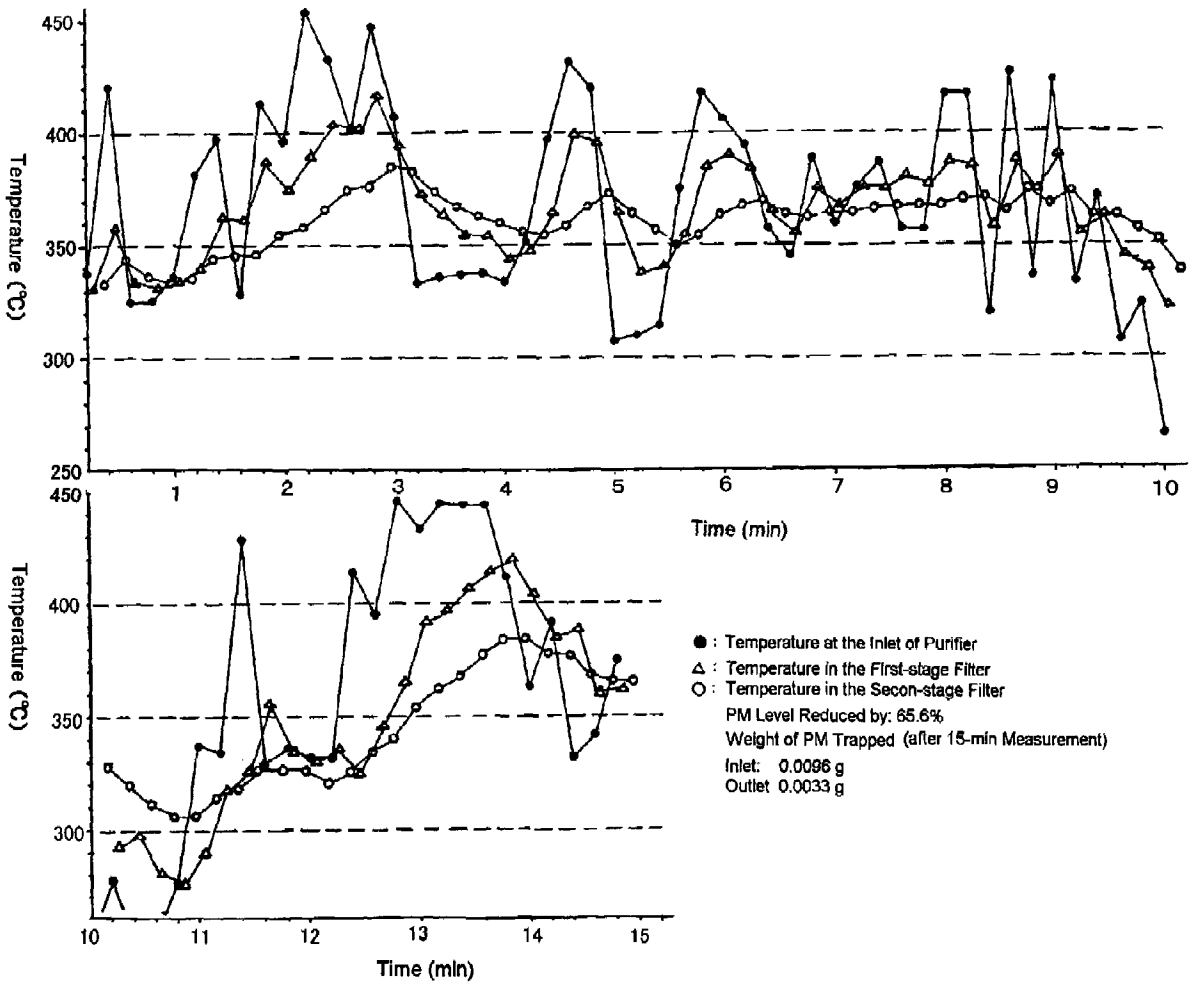
FIG. 10 is a graph showing the changes in the temperature of an exhaust from a diesel-powered vehicle that was driving at 70 km/h and which had the purifier fitted with two cleanup filters of the invention.
Figure 11:
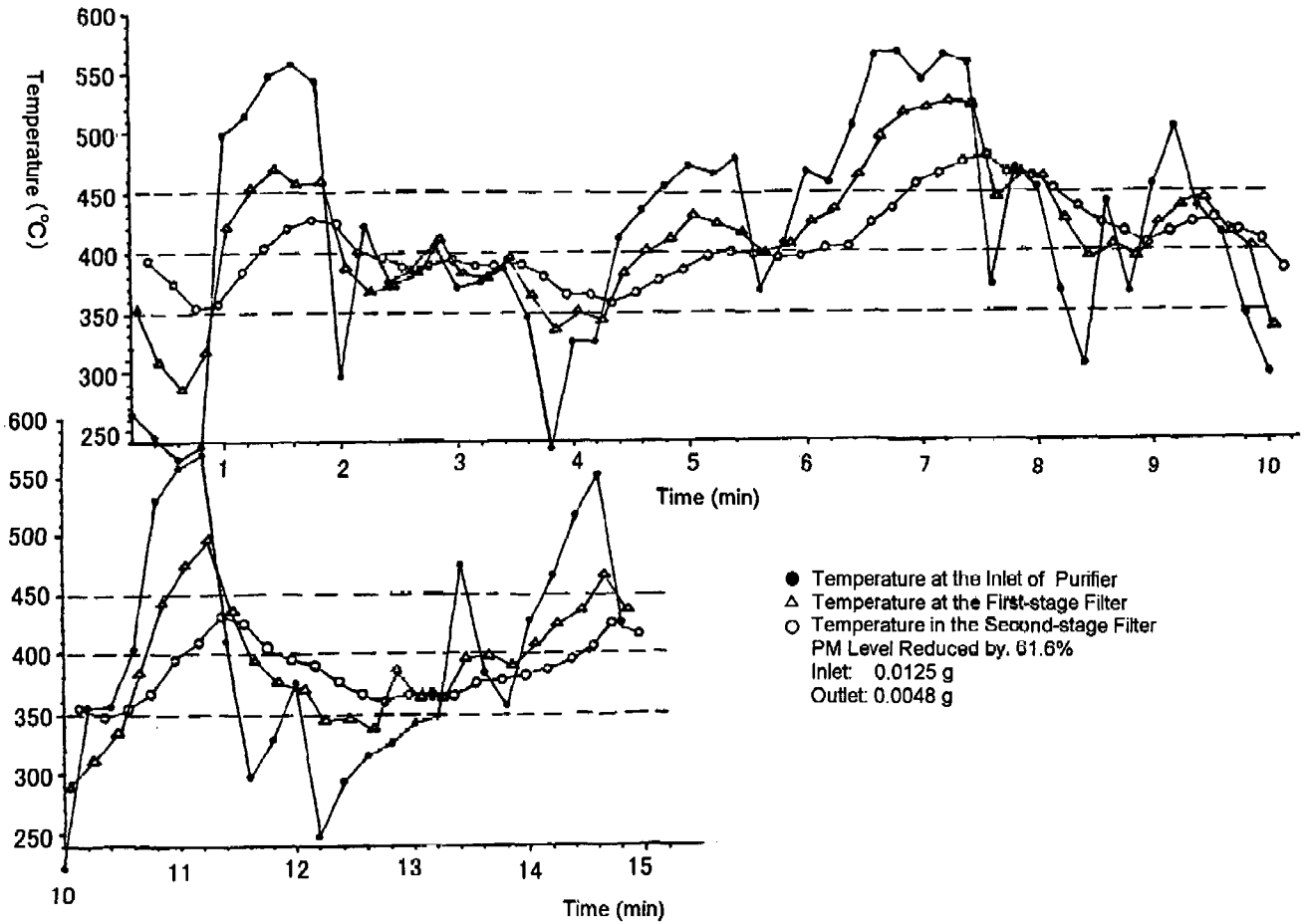
FIG. 11 is a graph showing the changes in the temperature of an exhaust from a diesel-powered vehicle that was driving at 80 km/h and which had the purifier fitted with two cleanup filters of the invention.

The PM level was measured for 15 minutes and the resulting changes in exhaust temperature at the inlet of the purifier, in the first-stage cleanup filter and in the second-stage cleanup filter (see FIG. 5) are depicted in FIGS. 9, 10 and 11 for different vehicle speeds of 60 km/h, 70 km/h and 80 km/h, respectively. The following were the average temperatures as calculated for the three constant speeds from the data shown in FIGS. 9, 10 and 11.

| | |
|---|---|
| (a) Average temperatures for driving at 60 km/h | |
| Inlet of the purifier | 287° C. |
| First-stage filter | 288° C. |
| Second-stage filter | 284° C. |
| (b) Average temperatures for driving at 70 km/h | |
| Inlet of the purifier | 362° C. |
| First-stage filter | 350° C. |
| Second-stage filter | 354° C. |
| (c) Average temperatures for driving at 80 km/h | |
| Inlet of the purifier | 396° C. |
| First-stage filter | 391° C. |
| Second-stage filter | 384° C. |

(d) Effectiveness for the Reduction of PM Level

The reduction of PM level was in excess of 60% at each of the test vehicular speeds.

(e) Back Pressure Measurements

Before the vehicle was started to operate, the exhaust's back pressure was 1 kg/cm$^2$ (with the engine rotating at 2000 rpm) and held substantially constant at each of the test vehicular speeds.

The above results show that even when the engine was rotating at high speed (at high load) during high-speed driving, the reduction of PM level was maintained above

TABLE 3

| Driving Cycle | Bus Speed | Engine Speed (rpm) | Temperature (° C.) | S-Point | Flow Rate (L/min) | S-Time (min) | S-Vol (m$^3$) | Back Pressure (kg/cm$^2$) | Sample Weight (g) | PM Weight (g) | Percent Removal (%) |
|---|---|---|---|---|---|---|---|---|---|---|---|
| EG-Start | — | — | — | — | — | — | — | — | — | — | |
| | 60 | 1,250 | 300 | IN | 20 | 15 | 0.30 | 0.5 | 0.1795 | 0.0068 | |
| ↑ | ↑ | ↑ | ↑ | OUT | 20 | 15 | 0.30 | 0.5 | 0.1752 | 0.0024 | 64.7 |
| ↑ | 70 | 1,480 | 350 | IN | 20 | 15 | 0.30 | 0.7 | 0.1803 | 0.0096 | |
| ↑ | ↑ | ↑ | ↑ | OUT | 20 | 15 | 0.30 | 0.7 | 0.1771 | 0.0033 | 65.6 |
| ↑ | 80 | 1,650 | 400 | IN | 20 | 15 | 0.30 | 0.9 | 0.1845 | 0.0125 | |
| ↑ | ↑ | ↑ | ↑ | OUT | 20 | 15 | 0.30 | 0.9 | 0.1768 | 0.0048 | 61.6 |
| EG-Stop | — | — | — | — | — | — | — | — | — | | |
| EG-Start | — | — | — | | Temperature measured | | | | | | |
| EG-Stop | — | — | — | | during city driving | | | | | | |

As one can see from Table 3, effective PM removal was achieved during high-speed drive, with values of 64.7%, 65.6% and 61.6% being obtained at speeds of 60 km/h, 70 60% and, as a result, the PM trapped in the filters was less likely to undergo "blow-off" and the filters were effectively regenerated. In addition, the back pressure of the exhaust was kept stable during driving at each of the test speeds and there was no PM buildup in the filters, indicating the occurrence of effective filter regeneration.

INDUSTRIAL APPLICABILITY

The invention provides:

(1) an exhaust cleanup filter which, even if the exhaust temperature is low due to driving as in a city, can trap PM efficiently to prevent clogging by PM buildup and which also is effective in purifying the exhaust from a diesel engine that does not use any burner or heater to remove PM;

(2) an exhaust cleanup filter that is free from the problem of an increase in the exhaust temperature due to clogging and which is less likely to experience abnormal combustion and filter fusion due to PM buildup; and (3) an exhaust cleanup filter which, even when the engine is rotating at high speed (at high load) during high-speed driving, the PM trapped in the filter is less likely to undergo "blow-off" and effective filter regeneration is accomplished.

The invention claimed is:

1. A cleanup filter for purifying the exhaust from diesel engines, which comprises:

a filter case filled with particulate ceramic porous bodies having a three-dimensional network structure, and said particulate ceramic porous bodies having an average particle size of 4.0 mm to 20 mm, artificial pores and communication channels that communicate between adjacent pores in the interior of said porous bodies and between pores extending to the surfaces of said porous bodies so as to expose some of the pores to the surfaces of said porous bodies, and pore sizes of 500 μm to 1000 μm.

2. The cleanup filter according to claim 1, wherein said particulate ceramic porous bodies are produced by mixing a ceramic feed with spheres of a thermoplastic resin such that those spheres occupy pore making portions, thereby having pores formed artificially and the communication channels that communicate with the adjacent pores.

3. The cleanup filter according to claim 1, wherein said particulate ceramic porous bodies contain silica as a main ingredient.

4. The cleanup filter according to claim 1, wherein said particulate ceramic porous bodies carry a catalyst system containing at least a noble metal catalyst.

5. The cleanup filter according to claim 1, wherein said particulate ceramic porous bodies carry a catalyst system containing at least a noble metal catalyst and an oxide catalyst.

6. The cleanup filter according to claim 4, wherein said noble metal catalyst is at least one member of the group consisting of platinum (Pt), palladium (Pd), rhodium (Rh) and iridium (Ir).

7. The cleanup filter according to claim 5, wherein said oxide catalyst is at least one member of the group consisting of cerium oxide, praseodymium oxide and samarium oxide.

8. A cleanup filter for purifying the exhaust from diesel engines, which comprises:

a filter case filled with particulate ceramic porous bodies having a three-dimensional network structure, and said particulate ceramic porous bodies having an average particle size of 4.0 mm to 20 mm, artificial pores and communication channels that communicate between adjacent pores in the interior of said porous bodies and between pores extending to the surfaces of said porous bodies so as to expose some of the pores to the surfaces of said porous bodies, and pore sizes of 500 μm to 1000 μm, whereby soot in the exhaust flows between adjacent particulate ceramic porous bodies as it collides with their surfaces and adsorbed onto those surfaces and trapped by the artificial internal pores and communication channels, thereby trapping the soot that during conditions of low exhaust temperature as on engine start-up.

9. The cleanup filter according to claim 8, wherein said particulate ceramic porous bodies are produced by mixing a ceramic feed with spheres of a thermoplastic resin such that those spheres occupy pore making portions, thereby having pores formed artificially and the communication channels that communicate with the adjacent pores.

10. The cleanup filter according to claim 8, wherein said particulate ceramic porous bodies contain silica as a main ingredient.

11. The cleanup filter according to claim 8, wherein said particulate ceramic porous bodies carry a catalyst system containing at least a noble metal catalyst.

12. The cleanup filter according to claim 8, wherein said particulate ceramic porous bodies carry a catalyst system containing at least a noble metal catalyst and an oxide catalyst.

13. The cleanup filter according to claim 8, wherein said particulate ceramic porous bodies carry a catalyst system containing at least a noble metal catalyst, said noble metal catalyst including at least one member of the group consisting of platinum (Pt), palladium (Pd), rhodium (Rh) and iridium (Ir).

14. The cleanup filter according to claim 8, wherein said particulate ceramic porous bodies carry a catalyst system containing at least a noble metal catalyst and an oxide catalyst, wherein said oxide catalyst is at least one member of the group consisting of cerium oxide, praseodymium oxide and samarium oxide.

* * * * *